US007412738B2

(12) United States Patent
Chaffee

(10) Patent No.: US 7,412,738 B2
(45) Date of Patent: Aug. 19, 2008

(54) FLUIDIC CHAMBERS FLUIDLY CONNECTED BY ONE WAY VALVE AND METHOD FOR USE

(76) Inventor: Robert Chaffee, 78 Montgomery St., Boston, MA (US) 02116

( * ) Notice: Subject to any disclaimer, the term of this patent is extended or adjusted under 35 U.S.C. 154(b) by 0 days.

(21) Appl. No.: 10/423,341

(22) Filed: Apr. 25, 2003

(65) Prior Publication Data

US 2003/0200611 A1 Oct. 30, 2003

Related U.S. Application Data

(60) Provisional application No. 60/402,151, filed on Aug. 9, 2002, provisional application No. 60/375,473, filed on Apr. 25, 2002.

(51) Int. Cl.
*A47C 27/08* (2006.01)
*A47C 20/00* (2006.01)

(52) U.S. Cl. ..... 5/706; 5/655.3

(58) Field of Classification Search ..... 5/710, 5/711, 633, 644, 691, 652, 654, 655.3, 706, 5/708, 712, 713; 297/452.41, DIG. 3
See application file for complete search history.

(56) References Cited

U.S. PATENT DOCUMENTS

| | | | | |
|---|---|---|---|---|
| 388,037 | A | 8/1888 | Hargin | |
| 918,391 | A | 4/1909 | Taarud | |
| 934,465 | A | 9/1909 | Rust | |
| 1,282,980 | A | 10/1918 | Takach | |
| 1,576,211 | A | 3/1926 | O'Kane | |
| 1,944,466 | A | 1/1934 | Rubin | |
| 2,369,736 | A * | 2/1945 | Hurt | 5/708 |
| 2,372,218 | A | 3/1945 | Manson et al. | |
| 2,415,150 | A | 2/1947 | Stein | |
| 2,434,641 | A | 1/1948 | Burns | |
| 2,549,597 | A | 4/1951 | Harris | |
| 2,575,764 | A | 11/1951 | Morner | |
| 2,604,641 | A | 7/1952 | Reed | |
| D167,871 | S | 9/1952 | Vega | |
| 2,614,272 | A | 10/1952 | Morner | |
| 2,672,628 | A | 3/1954 | Spanel | |
| 2,691,179 | A | 10/1954 | Kann | |
| 2,741,780 | A | 4/1956 | Kimbrig | |
| 2,842,783 | A | 7/1958 | Druck | |
| 2,853,720 | A | 9/1958 | Friedlander | |
| 3,008,214 | A | 11/1961 | Foster et al. | |
| 3,042,941 | A | 7/1962 | Marcus | |

(Continued)

FOREIGN PATENT DOCUMENTS

| | | |
|---|---|---|
| CH | 609850 | 3/1979 |

(Continued)

*Primary Examiner*—M. Safavi
(74) *Attorney, Agent, or Firm*—Lowrie, Lando & Anastasi, LLP.

(57) ABSTRACT

The present invention is directed to an inflatable device or a body support device, and, specifically, to an inflatable device including two or more fluid chambers. One embodiment of the device includes a first fluid chamber comprising a first outlet, and a second fluid chamber comprising an inlet, wherein the second fluid chamber is fluidly connected to the first fluid chamber by a one way valve arranged to allow fluid to pass from the second fluid chamber to the first fluid chamber. The invention is also directed to a method of providing adjustable support.

44 Claims, 5 Drawing Sheets

U.S. PATENT DOCUMENTS 3,128,480 A 4/1964 Lineback
3,155,991 A * 11/1964 Dunham ..... 5/708
3,274,624 A 9/1966 Noerdinger
D220,953 S 6/1971 Des Pres
3,680,917 A * 8/1972 Harris ..... 297/452.41
3,772,717 A 11/1973 Yuen et al.
3,790,975 A 2/1974 Phillip et al.
3,798,686 A 3/1974 Gaiser
3,813,716 A 6/1974 Francis
3,840,922 A 10/1974 Morrison et al.
3,864,766 A 2/1975 Prete, Jr.
3,877,092 A 4/1975 Gaiser
3,984,886 A 10/1976 Keeton
4,025,974 A 5/1977 Lea et al.
4,091,482 A 5/1978 Malcolm
4,099,773 A 7/1978 Chang
4,149,285 A 4/1979 Stanton
4,169,295 A 10/1979 Darling
D253,983 S 1/1980 McRight
4,348,779 A 9/1982 Leber
4,371,999 A 2/1983 Reid
4,405,129 A 9/1983 Stuckey
4,528,704 A * 7/1985 Wegener et al. ..... 5/81.1 R
4,594,743 A 6/1986 Owen et al.
4,644,597 A 2/1987 Walker
4,807,554 A 2/1989 Chi-Hung
4,862,533 A 9/1989 Adams
4,896,389 A 1/1990 Chamberland
4,905,332 A 3/1990 Wang
4,964,183 A 10/1990 LaForce, Jr.
4,970,741 A 11/1990 Spina
4,982,466 A 1/1991 Higgins et al.
5,044,030 A 9/1991 Balaton
5,068,933 A 12/1991 Sexton
5,079,785 A 1/1992 Garcia
5,117,517 A 6/1992 Su
5,163,196 A 11/1992 Graebe et al.
D335,999 S 6/1993 Van Driessche
5,226,184 A 7/1993 Cheng
5,243,722 A 9/1993 Gusakov
D343,980 S 2/1994 Torchia
5,349,984 A 9/1994 Weinheimer et al.
5,367,726 A 11/1994 Chaffee
5,423,094 A * 6/1995 Arsenault et al. ..... 5/655.3
5,493,742 A 2/1996 Klearman
5,598,593 A 2/1997 Wolfe
5,619,764 A 4/1997 Lopau
5,638,565 A 6/1997 Pekar
5,689,845 A 11/1997 Sobieralski
5,699,569 A 12/1997 Schwarz-Zohrer
D391,435 S 3/1998 Song et al.
5,845,352 A 12/1998 Matsler et al.
D405,636 S 2/1999 Stewart
5,898,963 A * 5/1999 Larson ..... 5/644
5,902,011 A 5/1999 Hand et al.
5,947,563 A 9/1999 Klimenko
5,951,111 A 9/1999 Klimenko
D414,976 S 10/1999 Su et al.
5,963,997 A 10/1999 Hagopian et al.
6,042,186 A * 3/2000 Kojic et al. ..... 297/452.41
6,076,214 A 6/2000 Klimenko
6,102,759 A 8/2000 Klimenko
6,131,219 A 10/2000 Roberts
6,148,461 A * 11/2000 Cook et al. ..... 5/713
6,152,530 A 11/2000 Hsu et al.
6,189,168 B1 2/2001 Graebe
6,219,868 B1 4/2001 Wang
D441,586 S 5/2001 Su
6,224,444 B1 5/2001 Klimenko
6,237,621 B1 5/2001 Chaffee
6,237,653 B1 5/2001 Chaffee
6,240,584 B1 * 6/2001 Perez et al. ..... 5/713
D448,229 S 9/2001 Su et al.
6,283,056 B1 9/2001 Tchaikovsky
6,397,417 B1 6/2002 Switlik
6,397,419 B1 6/2002 Mechache
6,446,289 B1 9/2002 Su et al.
D464,225 S 10/2002 Boso et al.
6,539,568 B2 4/2003 Lee, Jr.
6,550,086 B2 4/2003 Boyd
6,568,011 B2 5/2003 Fisher et al.
6,611,981 B1 * 9/2003 Lin ..... 5/708
6,701,559 B2 3/2004 Boso et al.
6,996,867 B2 * 2/2006 Boso et al. ..... 5/739
7,107,641 B2 * 9/2006 Davis ..... 5/710
2002/0050010 A1 5/2002 Shimada
2002/0116765 A1 8/2002 Smith et al.
2003/0066489 A1 4/2003 Whitehill
2003/0159218 A1 * 8/2003 Lin et al. ..... 5/710
2004/0107503 A1 6/2004 Tu
2004/0226101 A1 11/2004 Lin et al.

FOREIGN PATENT DOCUMENTS

WO WO 9629917 10/1996
WO WO 9857560 12/1998
WO WO 0215835 2/2002

* cited by examiner

FLUIDIC CHAMBERS FLUIDLY CONNECTED BY ONE WAY VALVE AND METHOD FOR USE

RELATED APPLICATIONS

This application is a non-provisional of and claims priority under 35 U.S.C. §119(e), to provisional application Ser. No. 60/375,473, filed Apr. 25, 2002, and provisional application Ser. No. 60/402,151, filed Aug. 9, 2002. The contents of these prior application specifications are incorporated herein by reference.

BACKGROUND

1. Field of the Application

The present invention is directed to inflatable devices, and, specifically, to an inflatable device including two or more fluid chambers that may be fluidly connected by a one way valve such that each chamber may be inflated through a single inlet and exhausted through a single outlet, and such that the amount of fluid in one of the fluid chambers may be adjusted independently of the other.

2. Related Art

Inflatable devices are used in a variety of contexts where buoyancy or a cushioned support is needed, where space is limited, or portability is desired. For example, inflatable mattresses, cushions and other body supports are used for applications such as camping, hospital bedding, and both occasional and everyday bedding in the home. Other uses of inflatable devices may provide support, health, comfort, and safety.

Such inflatable devices are often provided with a mechanism to adjust a degree of inflation of the inflatable device to adjust the amount of support and comfort provided by the inflatable device. However, such inflatable devices typically comprise a single bladder and there is a trade off between the amount of support that the device can provide based on the degree of inflation and the comfort of the device. For example, the device may be fully inflated to the maximum pressure to provide maximum support, but a user may find that the device lacks comfort. In contrast, the user may adjust the inflatable device to a degree of inflation less than a maximum inflation level providing a desired comfort, but the amount of support provided by the device is compromised. For example, the under-inflated inflatable device tends to sag, such as, an inflatable mattress may sag in the middle when supporting the user.

Alternatively, one example of a sleep support system including more than one inflatable chamber for sleep surface adjustment is disclosed in U.S. Pat. No. 6,397,419 B1(the '419 patent). The '419 patent discloses a sleep support system that includes a first fluid chamber positioned side-by-side with a second fluid chamber and separated by a foam center wall. The first fluid chamber and the second fluid chamber are surrounded by an upper wall, lower wall and side walls structure. In addition, the sleep support system comprises a base pad which may be a foam such as an L9 foam or alternatively an additional fluid chamber that is placed below the first and second fluid chambers and that is used to lift the fluid chambers to a level that is substantially even with the top wall of the side walls.

One embodiment of the sleep support system includes one of the fluid chambers coupled to the base pad fluid chamber through an external fluid pump and hand control. In this embodiment, the first fluid chamber can be inflated to its maximum firmness while maintaining the base pad fluid chamber essentially void of any pressurization. Then, a user can flip a switch on the hand control to change the flow of air from the fluid pump so that the fluid pump no longer supplies the fluid to the first fluid chamber, but rather fluid is now directed from the first fluid chamber to the base pad fluid chamber with the idea of maintaining the height of the combination of the first fluid chamber and the base pad fluid chamber, even though the first fluid chamber is reduced in its fluid volume. Similarly, the hand control and fluid pump can be used to cause fluid to flow from the base pad fluid chamber to the first fluid chamber thereby maintaining the height of the overall combination of the first fluid chamber and base pad fluid chamber. With this embodiment of the disclosed sleep support system, the fluid chambers are linked through the external fluid pump such that fluid from one chamber is directed into another chamber to change the pressurization in one chamber. In other words, each chamber cannot be independently pressurized and adjusted.

SUMMARY OF THE INVENTION

In one embodiment, the invention is directed to an inflatable device, comprising a first fluid chamber comprising a first outlet, and a second fluid chamber comprising an inlet. The inflatable device also comprises a one way valve fluidly connecting the first fluid chamber to the second fluid chamber, that is arranged to allow fluid to pass from the second fluid chamber to the first fluid chamber.

In another embodiment, the invention is directed to a method of providing adjustable support with an inflatable device. The method includes inflating a first fluid chamber and a second fluid chamber of the inflatable device through an inlet of the second fluid chamber and a one-way valve fluidly connecting the first and second fluid chambers, and releasing fluid from the second chamber while maintaining a fluid level in the first chamber.

In another embodiment, the invention is directed to a method of providing adjustable body support with an inflatable body support device. The method includes providing the inflatable body support device with a first fluid chamber that is configured as a structural support chamber that is to be used as a bottom chamber of the device, and with a second fluid chamber that is configured to be a comfort chamber to be disposed above the structural support chamber, the first and second chambers being fluidly segregated. The method includes inflating the first fluid chamber to a first level of inflation. The method further includes inflating the second fluid chamber to a second level of inflation and adjusting the second level of inflation of the second fluid chamber by releasing fluid from the second fluid chamber, while maintaining the first level of inflation in the first fluid chamber.

Another embodiment of an inflatable device of the invention comprises a first fluid chamber that is configured as a structural support chamber that is to be used as a bottom chamber of the device comprising a first inlet and a first outlet, and a second fluid chamber that is configured to be a comfort chamber to be disposed above the structural support chamber, comprising a second inlet and a second outlet. The first fluid chamber and the second fluid chamber are fluidly segregated.

BRIEF DESCRIPTION OF THE DRAWINGS

The application will be better understood and its advantages more apparent in view of the following detailed description, especially when read with reference to the appended drawings, wherein.

DETAILED DESCRIPTION

Figure 1:
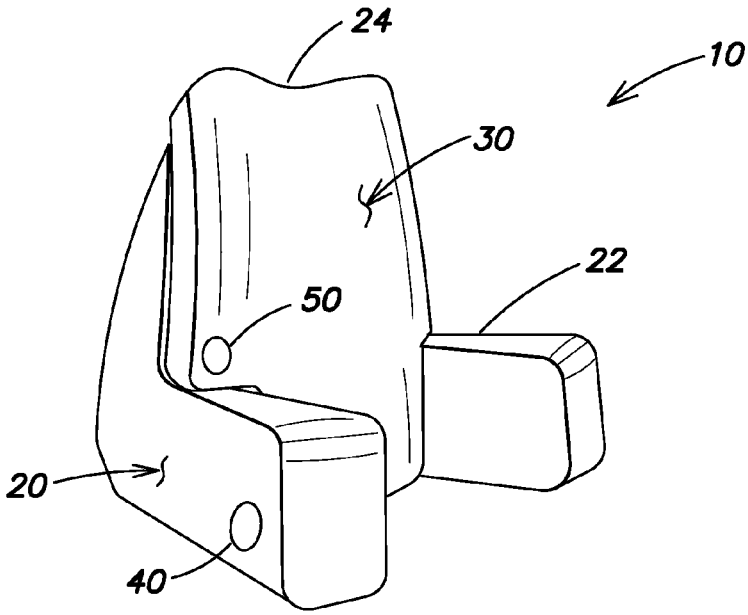
FIG. 1 is perspective, elevational view of one embodiment of an inflatable device according to the present invention.

It is to be understood that a body support device, as used herein, includes, for example, a mattress, a chair seat, a chair back, a head rest, a leg or foot support device, or any other device that is used for, for example, sitting, reclining, lying down or in general supporting a person. It is to be understood that such body support devices may comprise at least one inflatable device, as used herein, and may also comprise but need not comprise a solid surface, a padded surface, an upholstered surface, and may also comprise any number of types of support structure, such as foam, springs, suspension straps and the like. As used herein, "inflatable" means able to be inflated by any fluid, such as a gas, air, or a liquid, and the like. An inflatable device comprises at least one fluid impermeable bladder that can be inflated and sealed, and may comprise many shapes, sizes, constructions, and can be made from any of a plurality of materials.

The present invention is directed to inflatable devices and body support devices, and, in one embodiment, to an inflatable device including two or more fluid chambers fluidly connected by a one way valve such that both chambers may be inflated through a single inlet and exhausted through a single outlet of the inflatable device, and such that the amount of fluid in one of the fluid chambers may be adjusted independently of the other. This arrangement of an inflatable device comprising two fluid chambers, that may be separated by a one way valve, has an advantage over the prior art in that it provides structural support and the capability to adjust the degree of inflation to conform to a particular load or use, because one chamber may be used to provide structure, and the other chamber may be adjusted to fit a particular use or situation.

In the prior art, decreasing the amount of inflation in an inflatable device to conform to a load or use typically sacrifices some overall structural stability with, for example, single fluid chamber inflatable devices. In contrast, some embodiments of the inflatable device and body support device of the invention, for example, comprise a structural chamber and a comfort chamber, allowing the inflation to be adjusted in the comfort chamber without adjusting the inflation in the structural chamber, and thus without compromising structure. Furthermore, some embodiments of the present invention allow this selective adjustment without sacrificing the simplicity of a single inlet for inflation and a single outlet for deflation.

In one embodiment of the present invention, an inflatable device includes a first fluid chamber having an outlet and a second fluid chamber having an inlet. The second fluid chamber is fluidly connected to the first fluid chamber by a one way valve arranged to allow fluid to pass from the second fluid chamber into the first fluid chamber. The inflatable device may be shaped and arranged, either itself or as part of any of a body support device, as a chair, mattress, pillow, cushion, and the like.

Exemplary embodiments of the invention will now be illustrated with reference to the figures, and in particular, FIGS. 1 and 2. In the embodiment of the invention illustrated in FIGS. 1 and 2, an inflatable device 10 is shaped, sized and arranged as a back support pillow, and includes a first fluid chamber 20 having an outlet 40 and a second fluid chamber 30 having an inlet 50. Second fluid chamber 30 is fluidly connected to first fluid chamber 20 by a one way valve 60 arranged to allow fluid to pass from second fluid chamber 30 into first fluid chamber 20.

Figure 2:
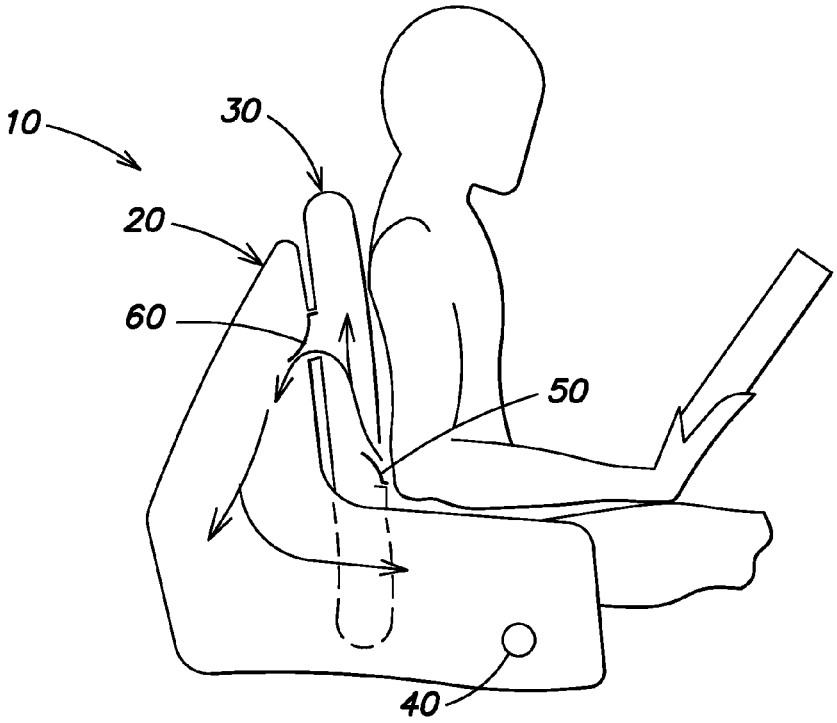
FIG. 2 is a side, elevational view of the inflatable device of FIG. 1.

This embodiment of an inflatable device 10 of the invention may be used, for example, as a bed sitting pillow as illustrated in FIGS. 1 and 2, where first and second fluid chambers 20, 30 may be constructed to have an overall crescent shape or other shape that will adequately support a person's back. For example, the inflatable device 10 may include a raised back portion 24 and armrests 22. It is to be appreciated that the raised back portion 24 and/or the armrest 22 can be formed from the first and second fluid chambers or can be additional structure, separate and apart from the first and second fluid chambers, such as a foam structure. In this embodiment, the first fluid chamber 20 is constructed as a structural layer designed to maintain the shape of inflatable device 10 and to hold the user's back at a desired angle. In this embodiment, the second fluid chamber 30 is constructed as a comfort layer that can be adjusted to a desired comfort or to provide a particular posture. It is to be appreciated that the arrangement of first and second fluid chambers 20, 30 within the overall shape of inflatable device 10 may take many forms. For example, as illustrated in the embodiment of FIGS. 1 and 2, first fluid chamber 20 may form the bulk of inflatable device 10, with second fluid chamber 30 comprising only a portion of inflatable device 10 where the user's back contacts it. In another embodiment, second fluid chamber 30 may extend to other portions of inflatable device 10, such as onto armrests 22.

It is to be appreciated that the first and second fluid chambers 20, 30 may be constructed in any manner and of any material(s) capable of retaining a desired fluid under a degree of pressure necessary for their intended application. For example, first and second fluid chambers 20, 30 may be constructed of a substantially fluid impermeable barriers and may be shaped in accordance with the intended use of a back support 10.

In another embodiment, inflatable device 10 can be shaped and arranged as a body support device in the form of a mattress, as illustrated in FIGS. 3-6. First and second fluid chambers 20, 30 may, together themselves or as part of an overall body support device, be constructed in the shape and height of a conventional mattress, allowing inflatable device 10 to be used with a conventional bed frame and bedding, if desired. In one embodiment of inflatable device 10 constructed as a mattress, first fluid chamber 20 is a structural layer or underlying layer designed to provide structure to the overall inflatable device and/or reduce the chances of contacting a surface supporting inflatable device 10 when weight is not evenly distributed on inflatable device 10. In other words, first fluid chamber 20 is a mattress foundation layer, analogous to a box spring of a conventional mattress. In this embodiment, the second fluid chamber 30 is a comfort layer that can be adjusted to provide a desired level of comfort to a person's preference. In other words, the second fluid chamber is intended to be in contact with a person and can provide comfort and support to the subject, analogous to a top mattress of a conventional mattress set. In this embodiment, first and second fluid chambers 20, 30 may be roughly the same size and shape, however, it is to be understood that many variations are possible and are within the scope of the invention. For example, the second fluid chamber 20 may be thicker or thinner than the first fluid chamber 30. It should be understood that the structural layer 20 also functions to improve comfort and that the comfort layer 30 provides some structure, that the terms structural layer and comfort layer refer to the primary function of the fluid chamber, but not its only function.

It is to be appreciated that in some applications of the inflatable device of the invention, such as the inflatable device shaped and constructed as a mattress, the second fluid chamber that overlays the first fluid chamber can be thinner than a conventional inflatable mattress comprising a single bladder. This results from the fact that the first fluid chamber also can function as both a support layer and a comfort layer, for example, when the overlying second fluid chamber is inflated at low pressure levels that may result, for example, in certain points of a body contacting the underlying first fluid chamber. It is also to be appreciated that the support and comfort characteristics of the multi-layer inflatable device of the invention differ from that of a single bladder of similar shape and size. For example, a single bladder, at lower levels of inflation, would tend to become more deeply depressed in response to loading of the bladder by, for example, a body. In contrast, with the dual bladder arrangement of the invention, the underlying first fluid chamber acts to limit such depression and thereby reduce any sagging that would result from the second fluid chamber having a low level of inflation. Accordingly, some advantages of the dual fluid chamber inflatable device of the present invention are that the combination can be adjusted to provide a more comfortable device with better support. In addition, the inflatable device having dual fluid chambers provides more options for sleeping and body support posture, with an ability to adjust the level of inflation of each fluid chamber. For example, the dual fluid chamber inflatable device of the invention can be adjusted to provide a sleeping posture, and a reclining posture to be used, for example, for reading or watching television, and the like.

It should be appreciated that inflatable device 10 of the invention comprising two fluid chambers 20, 30, need not be constructed such that it is a body support device. Other applications, such as packaging or shipping matter, or for supporting fragile objects, may also benefit from the present invention. Accordingly, embodiments of the present invention may be constructed as other support devices and are not limited to a body support device.

It is to be understood that first and second fluid chambers 20, 30 may include internal structure, such as ribs or partitions. For example, first and second fluid chambers 20, 30 may each be divided into two or more separate fluid containing compartments. In one embodiment, an inflatable device may comprise a single fluid bladder divided into fluid chambers 20, 30 and fluidly connected by one way valve 60. Alternatively, first and second fluid chambers 20, 30 can share one or more walls, and can be fluidly coupled together by a one way valve.

Figure 7:
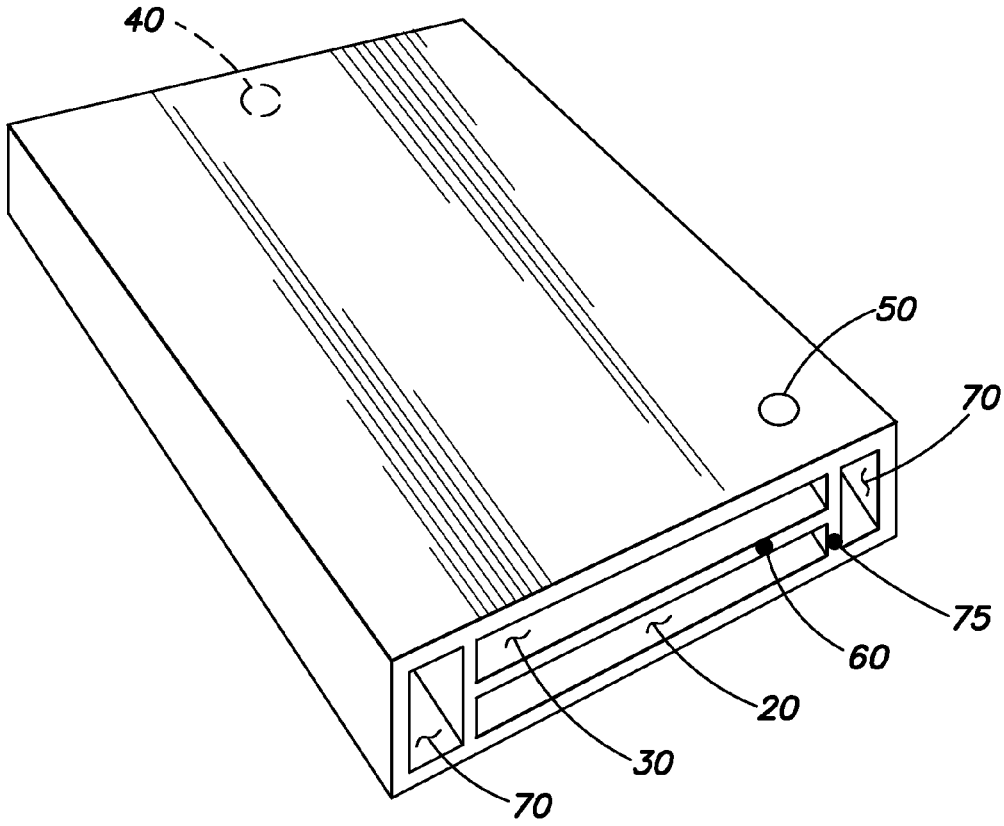
FIG. 7 is a perspective view of another embodiment of an inflatable device according to the invention.

Another embodiment of an inflatable device or body support device of the invention comprises more than two fluid chambers. For example, referring to FIG. 7, the first fluid chamber 20 may be constructed as structural layer for a double mattress and the second fluid chamber 30 may be constructed as a comfort layer. The first and second fluid chambers can be connected by a one-way valve 60, as discussed above. In addition, at least one third fluid chamber 70 is provided and is connected by a one way valve 75 to the first fluid chamber. In this embodiment, the third fluid chamber provides support at each edge of the inflatable device 10, providing additional support to a person sitting on an edge of the inflatable device or rolling near an edge.

It is to be appreciated that the third fluid chamber 70 can be a single fluid chamber disposed about a periphery of the first and second chambers, or can comprise more than one fluid chamber. As an alternative, the first fluid chamber 20 may be shaped such that it extends up to the upper surface of inflatable device 10 at the edges, providing additional support to those sitting on inflatable device 10 or rolling near its edge while sleeping. In another embodiment, the third fluid chamber 70 can be replaced by a suitable foam, such as an L9 foam, for the same purpose. In another embodiment, second fluid chamber 30 and the third fluid chamber 70 can be provided as two separate comfort layers on top of support layer 20, such that each of the second and third fluid chamber can separately be adjusted to a desired comfort level, for a different person or part of the body. In this embodiment the first fluid chamber can be adjusted to provide support to the second and third fluid chambers. It is to be appreciated that the first, second, and third fluid chambers 20, 30, 70 may also include internal structure to control the movement of fluid within first, second, and third fluid chambers. For example, any of first, second, and third fluid chambers 20, 30, 70 may include baffles or walls within the fluid chambers to improve the flow of fluid when the first, second and third fluid chambers are inflated or deflated.

It is to be appreciated that a wall thickness of any of the first, second, and third fluid chambers 20, 30, 70 may be of any thickness that substantially contains a fluid under pressures at which the first, second, and third fluid chamber will be used. The thickness of the wall may depend upon the material from which the first, second, and third fluid chamber 20, 30, 70 is constructed. For example, more durable or elastic materials may result in a thinner wall for the first, second, and third fluid chambers than less durable or elastic materials. Typically, the wall of the first, second, or third fluid chambers may be about 4-16 mils thick.

Further, the first, second, and third fluid chambers 20, 30, 70 may each be constructed of any material or materials capable of substantially containing a fluid and forming a fluid chamber strong enough to withstand a pressure at which the fluid chamber is to be used. For example, the first, second, and third fluid chambers 20, 30, 70 may be constructed of a polymeric material such as a thermoplastic. First, second and third fluid chambers 20, 30, 70 also may be constructed from a relatively inexpensive, easy to work with, and durable material. Some example materials may include polyvinyl chloride film and polyurethane. The manner of making the first, second, and third fluid chambers 20, 30, 70 may depend on their material of construction and configuration, as will be recognized by one of ordinary skill in the art.

In some embodiments of the invention, the second fluid chamber 30 may include an inlet 50. Inlet 50 may be constructed in any manner and using any materials that allow the inlet 50 to permit fluid to pass into the second fluid chamber 30, as desired. For example, the inlet 50 may be a sealable opening, comprising a one-way valve or a two-way valve such as disclosed in U.S. Pat. No. 6,237,621, herein incorporated by reference, or an orifice with a mating cap. Inflatable device 10 may include additional inlets in any fluid chamber such as the first fluid chamber 20, but according to some embodiments of the invention such inlets are not required. Inlet 50 may also include structure to mate with an inflation device, such as a pump. For example, the inlet 50 may have structure that interlocks with structure on an inflation device through a snapping action, or a twisting action or a rotating motion such as disclosed in U.S. Pat. No. 6,237,653, herein incorporated by reference.

One way valve 60, 75 may be constructed in any manner and using any material or materials that allow it to permit fluid to pass between the fluid chambers 20, 30, and 70 in a first direction, but not in a second direction. In other words, the one way valve 60, 75 allows fluid to pass from second fluid chamber 30 to first fluid chamber 20 and from first fluid chamber 20 to third fluid chamber 70, but prevents fluid movement from first fluid chamber 20 to second fluid chamber 30 and from third fluid chamber 70 to first fluid chamber 20. One way valve 60, 75 may include a conventional valve having a closing member, such as a diaphragm, and a valve seat.

In one embodiment of such a valve, disclosed in U.S. Pat. No. 6,237,621, the closing member is biased against the valve seat, for example by a hinge-mounted, bias assembly, and may be biased open by fluid pressure exerted on the valve in a first direction (e.g. from the second fluid chamber to first fluid chamber); conversely, fluid pressure exerted from a second direction (e.g. from the first fluid chamber to second fluid chamber) pushes the closing member against the valve seat, biasing it against the valve seat. In such a valve, the bias force of the valve toward closure may be balanced against the amount of fluid pressure required to open it. In a preferred arrangement, the valve is configured to remain closed where the fluid chambers are of substantially the same pressure or where the pressure is greater on the side of the valve from which the closing member is pressed against the seat (e.g. the first fluid chamber 20) and is opened where pressure on the opposite side (e.g. second fluid chamber 30) is slightly greater. It is to be appreciated that one manner of configuring the bias of the valve toward closure and the pressure required to open it, is by the selection of the closing member. For example, a thinner, more flexible closing member may be more easily opened but have less bias toward closure, while a thicker, stiffer closing member may be more difficult to open but have more bias toward closure. It is to be appreciated that one way valve 60, 75 may also include other devices and systems that allow fluid to pass in only in direction. For example, a membrane that allows fluid to pass in only one direction may be used in this capacity. It is further to be appreciated that the one way valve 60, 75 may be provided with a biasing structure to bias open and close the valve structure such as, for example, a motor or a solenoid.

In some embodiments of the invention, first fluid chamber 20 may include an outlet 40. Outlet 40 may be constructed in any manner and of any material(s) that allow it to permit fluid to flow from inside first fluid chamber 20 to outside first fluid chamber 20, as desired. For example, outlet 40 may be a sealable opening, sealable with a valve that can be used to regulate pressure in the chamber, or that can be fully opened to exhaust air from the chamber, such as disclosed in U.S. Pat. No. 5,367,726 herein incorporated by reference, or simply an orifice with a mating cap.

It is to be appreciated that additional outlets may be provided in any fluid chamber, if desired. For example, in order for the amount of fluid in second fluid chamber 30 to be adjusted independently of the amount of fluid in the first fluid chamber 20, it may be provided with one or more outlets. Such an outlet may be constructed in any manner that allows fluid to be released, as described with regard to outlet 40. In one embodiment, the outlet in the second fluid chamber can be combined with the inlet 50 as a two-way valve. In other words, inlet 50 may comprise a two-way valve that allows fluid to be provided to second fluid chamber 30, and that allows fluid to be exhausted from second fluid chamber 30, for example to adjust the pressure in second fluid chamber 30, such as disclosed in U.S. Pat. No. 6,237,621. It is also to be appreciated that the outlet of any fluid chamber may be positioned on inflatable device 10 such that it is easily accessed for adjustment by a user of the device. For example, where inflatable device 10 is a body support device such as a mattress or back support, the outlet in fluid chamber 30 may be positioned to be easily accessed by a user supported by inflatable device 10. For example, the outlet may be positioned on an upper surface of inflatable device 10 where it is easily activated by hand.

Figure 3:
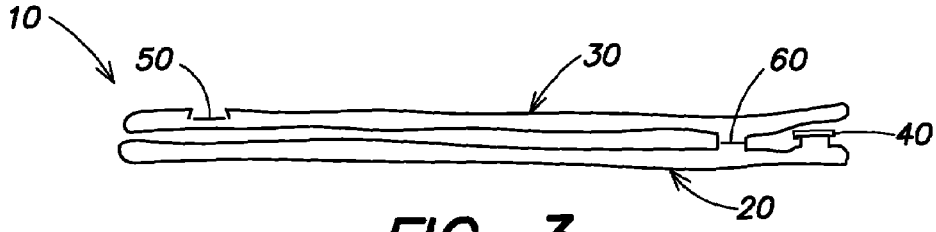
FIG. 3 is a side, cross-sectional view of another embodiment of an inflatable device according to the present invention in a partially deflated condition.
Figure 4:
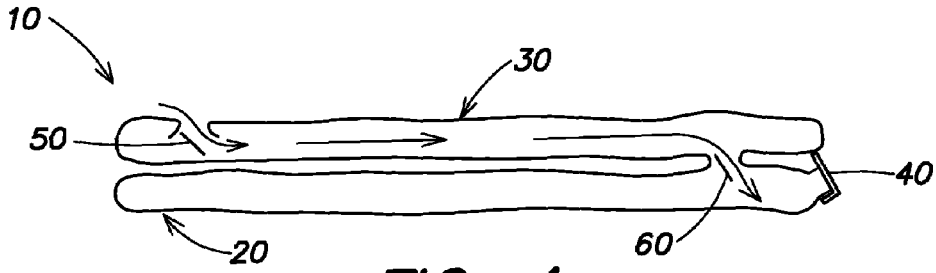
FIG. 4 is a side, cross-sectional view of the inflatable device of FIG. 3 in a partially inflated condition.
Figure 5:
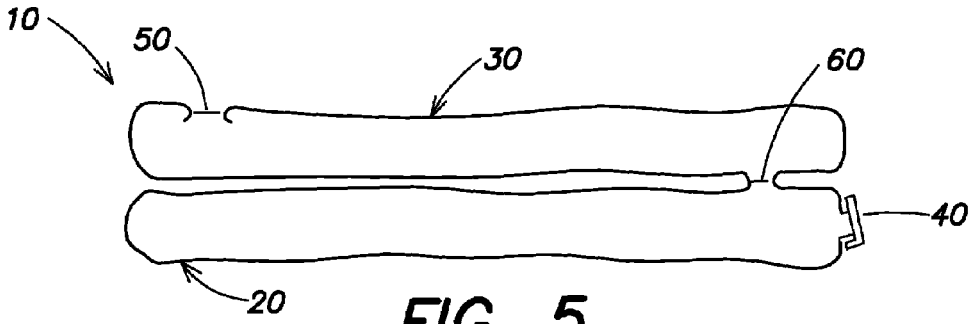
FIG. 5 is a side, cross-sectional view of the inflatable device of FIG. 3 in an inflated condition.
Figure 6:
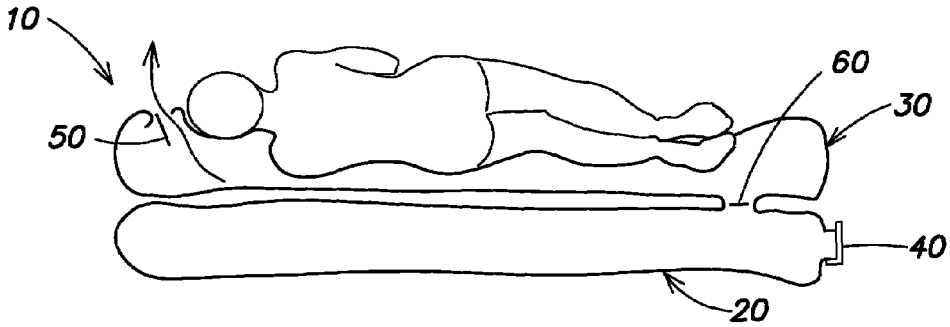
FIG. 6 is a side, cross-sectional view of the inflatable device of FIG. 3 in use.

Typical operation of an embodiment of inflatable device 10 of the present invention configured as a mattress is illustrated in FIGS. 3-6. By way of example, it is assumed that inflatable device 10 is initially in a wholly or partially deflated condition, as illustrated in FIG. 3. Fluid, such as air or water, may be introduced into inflatable device 10 through inlet 50. The fluid inflates the second fluid chamber 30 to a fluid threshold opening level of the one-way valve 60, and upon reaching the fluid threshold opening level also passes fluid through one way valve 60, inflating first fluid chamber 20, as illustrated in FIG. 4. Referring now to the embodiment illustrated in FIG. 7, for this embodiment the fluid inflates the first fluid chamber 20 to a fluid threshold opening level of the one-way valve 75, and upon reaching the fluid threshold opening level also passes fluid through one way valve 75, inflating the third fluid chamber 70. Referring again to FIGS. 5-6, when sufficient fluid has been introduced into inlet 50 to provide the desired degree of inflation or comfort, or support in either one of or both of the first and second fluid chambers (and the third fluid chamber for the embodiment of FIG. 7), inlet 50 may close or be closed, as illustrated in FIG. 5. A user, and in some cases a user supported on inflatable device 10, may activate an outlet in the second fluid chamber, which in one embodiment also comprises inlet 50, thereby adjusting the pressure in only second fluid chamber 30 to a desired level according to comfort or another support criteria, as illustrated in FIG. 6. In addition, the user can activate outlet 40 to separately adjust the desired support or level of inflation in the first fluid chamber 20. It is to be appreciated that an outlet (not illustrated) can also be provided in the third fluid chamber 70 (see FIG. 7) and that the amount of fluid in the third fluid chamber can also separately be controlled.

Figure 8:
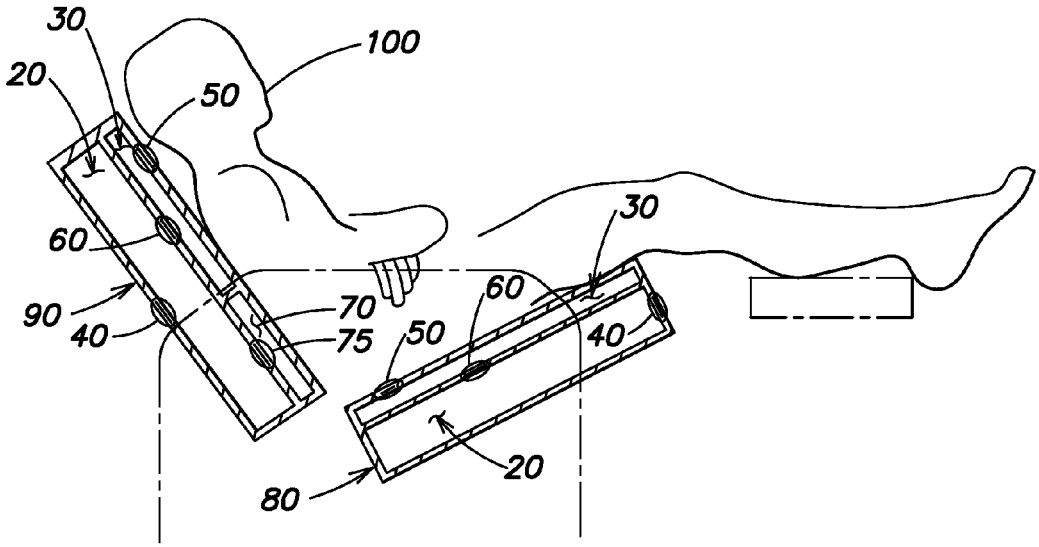
FIG. 8 is a side, perspective view of an embodiment of a chair body support device of the invention.

FIG. 8 illustrates another embodiment of the body support device of the invention, configured as a seat that has at least one reclining position. This embodiment comprises a seat portion 80 and a back portion 90 as illustrated in FIG. 8. The seat portion comprises at least a first bladder 20 and a second bladder 30 that, in one embodiment, may be fluidly connected by one way valve 60. In this embodiment the second fluid bladder contains an inlet 50 and the first fluid bladder contains an outlet 40. This seat surface 80 can be adjusted to provide both support and comfort as discussed above. The back portion 90 of the seat device comprises first bladder 20, second bladder 30, and, in one embodiment, a third bladder 70 that can function to provide lower back support to the subject 100. In one embodiment, the first bladder 20 and the second bladder 30 are fluidly connected by one way valve 60, and the first bladder 20 and the third bladder 70 are fluidly connected by one way valve 75. In this embodiment, the second bladder 30 is provided with an inlet 50 and the first bladder 20 may be provided with an outlet 40. The seat back portion 90 can be adjusted to provide support and comfort to the user 100 as discussed above.

Figure 9:
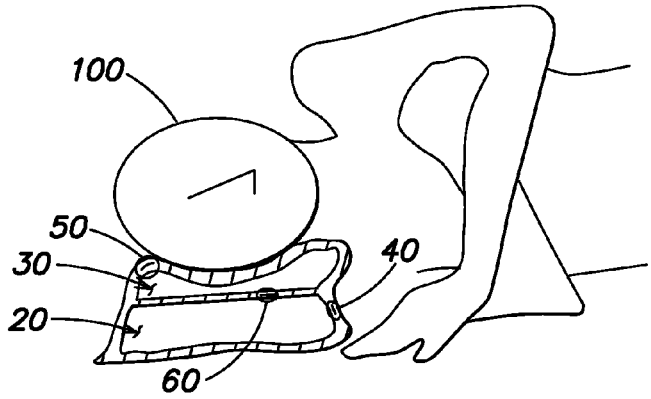
FIG. 9 is a cross-sectional view of a pillow body support device of the invention.

FIG. 9 illustrates another embodiment of a body support device of the invention, shaped and arranged as a pillow. The pillow is shown in a cross sectional view. One embodiment of the pillow comprises a first bladder 20 and a second bladder 30 fluidly connected by a one way valve 60. In addition, this embodiment comprises an inlet 50 in the second bladder 30 and an outlet 40 in the first bladder 20. With this arrangement, the pillow can be operated as above to provide both support and comfort to a head and neck of the subject 100, to provide a comfortable position for sleeping and may also be used to provide a proper posture for sleeping.

Figure 10:
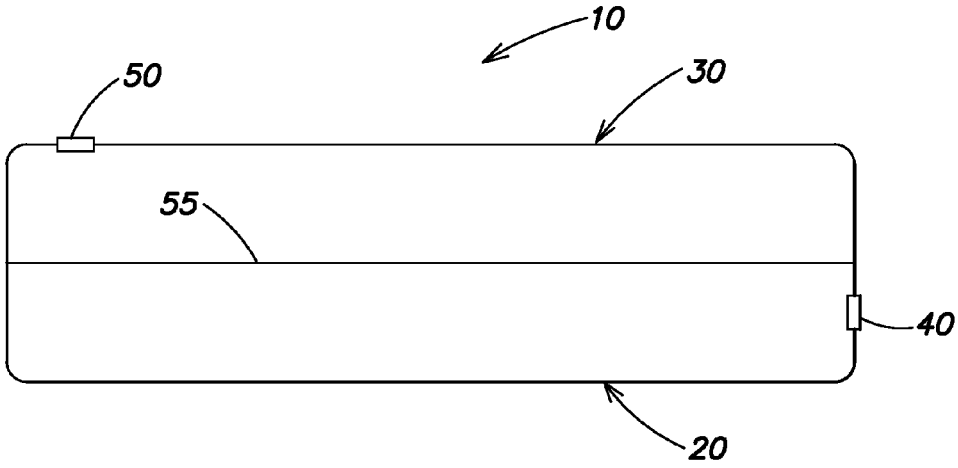
FIG. 10 is a side, cross-sectional view of another embodiment of an inflatable device according to the present invention in an inflated condition.
Figure 11:
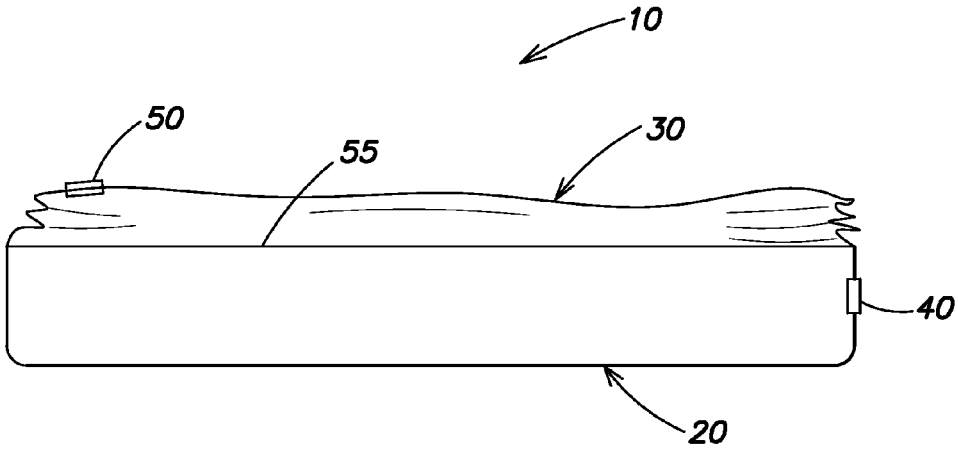
FIG. 11 is a side, cross-sectional view of the inflatable device of FIG. 10 in a partially inflated condition.

According to another embodiment of the invention, separate adjustment of each bladder, for example, in a two bladder inflatable device is not limited to embodiments where the bladders are connected by a one-way valve. According to this embodiment, as illustrated in FIGS. 10 and 11, the first and second 20, 30 bladders may be partially or completely fluidly segregated. In the illustrated example, first and second fluid chambers 20, 30 are permanently separated by a wall 55, which may be, for example, a common wall. However, it should be appreciated that in other embodiments the separation of the fluid chambers need not be permanent.

In this embodiment, first fluid chamber 20 may be inflated through inlet 40, which according to one embodiment comprises a two-way valve that provides for inflation and deflation of the first fluid chamber, to a level sufficient to provide a desired structure and/or support. The level of inflation may comprise a recommended or desired range of inflation to achieve the desired degree of structure and/or support. Second fluid chamber 30 may be separately inflated through inlet 50 to a level sufficient to provide a desired comfort and support, and the level of inflation therein may be adjusted, for example, by adding and/or releasing fluid, typically in relatively small increments through the valve 50. According to this embodiment, the first fluid chamber may be maintained at the predetermined level of inflation and/or adjusted by valve 40, while the level of inflation of the second fluid chamber is separately maintained and adjusted by valve 50.

As described previously, this embodiment of the inflatable device may include a first fluid chamber 20 that is a structural fluid chamber and a second fluid chamber 30 that is a body support fluid chamber. The structural fluid chamber 20 may be constructed to provide a desired structure to the inflatable device, while the body support fluid chamber 30 may be adjustable to provide a desired level of comfort and/or support. In such an embodiment, the structural fluid chamber may be inflated to a level sufficient to provide the desired structure, which may be a predetermined structural level of inflation. The structural level of inflation may comprise a recommended or desired range of inflation to achieve the desired degree of structural support. The support fluid chamber may be separately inflated to a level sufficient to provide the desired comfort, and then the level of inflation therein may be adjusted, for example, by adding and/or releasing fluid, typically in relatively small increments. The structural fluid chamber may be maintained at the structural level of inflation while the level of inflation of the support fluid chamber is adjusted to provide a desired level of comfort and/or support.

It is to be appreciated that various aspects of the present invention may be motorized or otherwise automated as desired. For example, fluid may be provided to inflatable device 10 such as disclosed in, for example, U.S. Pat. No. 5,367,726 by a pump that may mate with, or be permanently affixed to, inflatable device 10. The pump may be manual or electrical and, in some embodiments, may be integral with the valve 50 and may be positioned at least partially within the fluid chamber 30. A pump may also be used to deflate inflatable device 10 or to adjust the fluid in either second fluid chamber 30 or third fluid chamber 70. Inlet valve 50 and/or one way valve 60, 75 may also be mechanized. For example, a solenoid or motor driven mechanism may be used to operate inlet valve 50 and/or valve 60, 75 during inflation and deflation of inflatable device 10, and during adjustment of either fluid chamber.

It is also to be appreciated that where any electrical or mechanical devices are employed to aid in some use of inflatable device 10, such devices may include controls that are easily accessible. In some embodiments, more than one control, such as controls for both inflation and deflation, may be located in a single convenient location and within a single controller. In one preferred embodiment, the controls may be located on a controller that may be connected to inflatable device 10 only by a cord, or the like. In another embodiment, the controller can be a remote controller using infrared light, or the like, to control inflatable device 10 without the need to be connected by cords or cables.

It will be understood that each of the elements of the inflatable device described herein, or two or more together, may be modified or may also find utility in other applications differing from those described above. While particular embodiments of inflatable device of the application have been illustrated and described, it is not intended to be limited to the details shown, since various modifications and substitutions may be made without departing in any way from the spirit of the application as defined by the following claims.

What is claimed is:

1. An inflatable device, comprising:

a first inflatable fluid chamber;

a second inflatable fluid chamber constructed and arranged to overlay at least a portion of the first inflatable fluid chamber, the first fluid chamber adapted to support at least a portion of the second fluid chamber;

a two way valve configured as an inlet and an outlet for the second inflatable fluid chamber wherein the two way valve is located in a location accessible to a user to allow the user to release fluid from the second inflatable fluid chamber; and a one way valve fluidly connecting the first fluid chamber to the second fluid chamber, that is configured to allow a volume of fluid to pass from the second fluid chamber to the first fluid chamber and to substantially maintain the volume of fluid in the first fluid chamber when fluid is released from the second inflatable fluid chamber via the two way valve.

2. The inflatable device of claim 1, further comprising an inflatable comfort device adapted to support at least a part of a mass of the user, wherein the two way valve is located in the location accessible to the user with the inflatable device oriented in an orientation in which the inflatable device is intended for use.

3. The inflatable device of claim 2, wherein the first inflatable fluid chamber and the second inflatable fluid chamber are configured as horizontal layers, and wherein the first inflatable fluid chamber is located below the second inflatable fluid chamber with the inflatable device oriented in the orientation.

4. The inflatable device of claim 3, wherein the second inflatable fluid chamber is constructed and arranged to overlay a majority of the first inflatable fluid chamber.

5. The inflatable device of claim 4, wherein the second inflatable fluid chamber is constructed and arranged to overlay substantially all of the first inflatable fluid chamber.

6. The inflatable device of claim 1, wherein the two way valve is located within a wall of the second inflatable fluid chamber.

7. The inflatable device of claim 6, wherein the location is a location that allows the user to directly manipulate the two way valve.

8. The inflatable device of claim 6, wherein the wall provides a support surface for the user of the inflatable device.

9. An inflatable device, comprising:

a first inflatable fluid chamber configured as a first layer and comprising a first outlet;

a second inflatable fluid chamber constructed and arranged as a second layer to overlay at least a portion of the first inflatable fluid chamber;

a two way valve configured as an inlet and an outlet for the second inflatable fluid chamber; and a one way valve fluidly connecting the first fluid chamber to the second fluid chamber, and being configured and arranged to allow fluid to pass from the second fluid chamber to the first fluid chamber, wherein the first fluid chamber is adapted to support the second fluid chamber.

10. The inflatable device of claim 9, wherein the first fluid chamber is constructed and arranged as a structural layer and the second fluid chamber is constructed and arranged as a comfort layer.

11. The inflatable device of claim 9, wherein the inflatable device is constructed and arranged as a mattress.

12. The inflatable device of claim 9, wherein the inflatable device is constructed and arranged as a pillow.

13. The inflatable device of claim 9, wherein the inflatable device is constructed and arranged as a seat.

14. The inflatable device of claim 9, wherein the inflatable device is constructed and arranged as a back support portion of a chair.

15. The inflatable device of claim 9, wherein the inflatable device is constructed and arranged as a back support.

16. The inflatable device of claim 9, wherein the one way valve comprises a valve that is configured to open with sufficient fluid pressure and to form a seal against a valve seat in an absence of such fluid pressure.

17. The inflatable device of claim 9, wherein the two way valve is configured to allow an adjustment of the fluid level in the second fluid chamber.

18. The inflatable device of claim 17, wherein the two way valve is constructed and arranged to allow a flow of air from outside the second fluid chamber to inside the second fluid chamber to pressurize the fluid chamber and that also is configured to exhaust air from inside the second fluid chamber to outside the second fluid chamber, and wherein the one way valve is configured to prevent a passage of fluid from the first inflatable fluid chamber to the second inflatable fluid chamber when air is exhausted from inside the second fluid chamber to outside the second fluid chamber.

19. The inflatable device of claim 17, wherein the inflatable device is constructed and arranged as a body support device and the two way valve is constructed and arranged to be actuatable by a person being supported by the body support device to select a level of inflation of the second fluid chamber.

20. The inflatable device of claim 9, wherein the first fluid chamber and the second fluid chamber share at least one wall.

21. The inflatable device of claim 9, wherein the one way valve is configured and arranged to automatically pass air from the second fluid chamber to the first fluid chamber upon inflation of the second fluid chamber.

22. An inflatable device, comprising:

a first inflatable fluid chamber comprising a first outlet;

a second inflatable fluid chamber constructed and arranged to overlay at least a portion of the first inflatable fluid chamber, the first fluid chamber adapted to support at least a portion of the second fluid chamber;

a two way valve configured as an inlet and an outlet for the second inflatable fluid chamber; and a one way valve fluidly connecting the first fluid chamber to the second fluid chamber, that is arranged to allow fluid to pass from the second fluid chamber to the first fluid chamber.

23. The inflatable device of claim 22, wherein the inflatable device is constructed and arranged as a body support device.

24. The inflatable device of claim 23, wherein the body support device is constructed and arranged as a mattress.

25. The inflatable device of claim 23, wherein the body support device is constructed and arranged as a pillow.

26. The inflatable device of claim 23, wherein the body support device is constructed and arranged as a seat.

27. The inflatable device of claim 23, wherein the body support device is constructed and arranged as a back support portion of a chair.

28. The inflatable device of claim 23, wherein the body support device is constructed and arranged as a back support.

29. The inflatable device of claim 22, wherein the one way valve comprises a valve that is configured to open in response to sufficient fluid pressure and to form a seal against a valve seat in an absence of such fluid pressure.

30. The inflatable device of claim 22, wherein the two way valve is configured to allow an adjustment of the fluid level in the second fluid chamber.

31. The inflatable device of claim 30, wherein the two way valve is constructed and arranged to allow a flow of air from outside the second fluid chamber to inside the second fluid chamber to pressurize the second fluid chamber and that also is configured to exhaust air from inside the second fluid chamber to outside the second fluid chamber, and wherein the one way valve is configured to prevent a passage of fluid from the first inflatable fluid chamber to the second inflatable fluid chamber when air is exhausted from inside the second fluid chamber to outside the second fluid chamber.

32. The inflatable device of claim 30, wherein the inflatable device is constructed and arranged as a body support device and the two way valve is constructed and arranged to be actuatable by a person being supported by the body support device to select a level of inflation of the second fluid chamber.

33. The inflatable device of claim 22, wherein the first fluid chamber and the second fluid chamber are connected together.

34. The inflatable device of claim 22, wherein the second inflatable fluid chamber is constructed and arranged to overlay a majority of the first inflatable fluid chamber.

35. The inflatable device of claim 34, wherein the inflatable device provides a support surface for a user, and wherein the second inflatable fluid chamber provides a majority of the support surface.

36. The inflatable device of claim 35, wherein the second inflatable fluid chamber provides substantially all of the support surface.

37. The inflatable device of claim 35, wherein the support surface is a top surface of a mattress.

38. The inflatable device of claim 37, wherein the first inflatable fluid chamber is located beneath the second inflatable fluid chamber.

39. The inflatable device of claim 35, wherein the support surface is a back-support surface of a backrest.

40. The inflatable device of claim 35, wherein the support surface is a back-support surface of a chair.

41. The inflatable device of claim 35, wherein the support surface is a top surface of a pillow.

42. The inflatable device of claim 22, wherein the second inflatable fluid chamber provides a support surface for a user, and wherein the first inflatable fluid chamber and the second inflatable fluid chamber are disposed as layers substantially parallel to the support surface along an axis perpendicular to the support surface.

43. The inflatable device of claim 42, wherein the second inflatable fluid chamber is constructed and arranged to overlay a majority of the first inflatable fluid chamber.

44. A method of providing adjustable support with an inflatable device, comprising:

configuring a first fluid chamber and a second fluid chamber as a first layer and a second layer of the inflatable device, respectively, wherein the second fluid chamber overlays at least a portion of the first fluid chamber;

inflating the first fluid chamber and the second fluid chamber of the inflatable device through a two way valve configured as an inlet and an outlet for the second fluid chamber and a one way valve fluidly connecting the first and second fluid chambers, the act of inflating comprising providing the first fluid chamber with a sufficient fluid level to support the second fluid chamber;

releasing fluid from the second fluid chamber through the two way valve while maintaining the fluid level in the first fluid chamber, to provide a selected comfort level with the second fluid chamber; and releasing fluid from the first fluid chamber through an outlet of the first fluid chamber.

* * * * *